US009027372B2

(12) United States Patent
Hickman

(10) Patent No.: US 9,027,372 B2
(45) Date of Patent: May 12, 2015

(54) LOCK ASSEMBLY HAVING SECURED SETSCREW CONFIGURATION TO PREVENT UNAUTHORIZED HANDLE REMOVAL

(71) Applicant: Stanley Security Solutions, Inc., Indianapolis, IN (US)

(72) Inventor: Chad A. Hickman, Rensselaer, IN (US)

(73) Assignee: Stanley Security Solutions, Inc., Indianapolis, IN (US)

( * ) Notice: Subject to any disclaimer, the term of this patent is extended or adjusted under 35 U.S.C. 154(b) by 0 days.

(21) Appl. No.: 14/105,606

(22) Filed: Dec. 13, 2013

(65) Prior Publication Data

US 2014/0165674 A1 Jun. 19, 2014

Related U.S. Application Data

(60) Provisional application No. 61/738,975, filed on Dec. 18, 2012.

(51) Int. Cl.

| | |
|---|---|
| ***E05B 3/04*** | (2006.01) |
| ***E05B 17/20*** | (2006.01) |
| ***E05C 1/08*** | (2006.01) |
| ***E05B 63/00*** | (2006.01) |

(52) U.S. Cl.

CPC ..... *E05B 3/04* (2013.01); *E05B 17/2084* (2013.01); *E05C 1/08* (2013.01); *E05B 63/0004* (2013.01); *Y10S 16/24* (2013.01); *Y10T 16/458* (2015.01)

(58) Field of Classification Search

CPC ..... E05B 55/005; E05B 17/0058; E05B 63/0004; E05B 3/04; E05B 3/08; E05B 3/10; E05B 3/02; E05B 3/00; E05B 1/04; E05B 17/2084; Y10S 16/24; Y10T 16/458; E05C 1/08

USPC ..... 16/413, 412, DIG. 24; 70/141, 20, 368, 70/369, 370, 371, 215, 101, 104, 106, 107, 70/116, 158, 163, 182, 183, 185, 188, 197, 70/207, 208, 211, 221, 224, 263, 264, 265, 70/336, 344, 387, 416, 420, 447, 448, 451, 70/456 R; 292/347, 348, 350

See application file for complete search history.

(56) References Cited

U.S. PATENT DOCUMENTS

| | | | | |
|---|---|---|---|---|
| 1,964,787 | A * | 7/1934 | Voight | 70/369 |
| 3,324,693 | A * | 6/1967 | Check | 70/369 |
| 4,052,868 | A * | 10/1977 | Best et al. | 70/224 |
| 4,435,967 | A * | 3/1984 | Best et al. | 70/224 |

(Continued)

*Primary Examiner* — Christopher Boswell
*Assistant Examiner* — Amanda L Miller
(74) *Attorney, Agent, or Firm* — Richard J. Veltman; Adan Ayala

(57) ABSTRACT

A lock assembly includes a coupling mechanism connected to a spindle assembly. The coupling mechanism has an outer sleeve having a longitudinal interior opening that extends along a first axis. An operator handle includes a proximal lock core opening, and a distal shaft portion having an axial opening configured to receive the outer sleeve. The distal shaft portion and the outer sleeve are configured to define a through path oriented across the longitudinal interior opening of the outer sleeve. A portion of the through path at the outer sleeve is configured to threadably receive a setscrew to fasten the operator handle to the outer sleeve. A keyed lock core has a tailpiece that is positioned in the longitudinal interior opening of the outer sleeve to obstruct the through path and block access to the setscrew via the through path to prevent unauthorized removal of the operator handle.

17 Claims, 10 Drawing Sheets

(56) References Cited

U.S. PATENT DOCUMENTS

| | | | | | |
|---|---|---|---|---|---|
| 4,633,690 | A * | 1/1987 | Foshee | 70/451 |
| 4,765,163 | A * | 8/1988 | Trull et al. | 70/224 |
| 5,070,715 | A * | 12/1991 | Smallegan et al. | 70/369 |
| 5,291,767 | A * | 3/1994 | Weindorf et al. | 70/370 |
| 6,578,396 | B2 * | 6/2003 | Field et al. | 70/371 |
| 6,860,129 | B2 * | 3/2005 | Eller et al. | 70/217 |
| 8,201,307 | B2 * | 6/2012 | Romero | 16/412 |
| 2004/0123427 | A1 * | 7/2004 | Lee | 16/412 |
| 2009/0133454 | A1 * | 5/2009 | Frolov et al. | 70/279.1 |
| 2010/0005842 | A1 * | 1/2010 | Herdman | 70/368 |
| 2011/0252843 | A1 * | 10/2011 | Sumcad et al. | 70/91 |

* cited by examiner

LOCK ASSEMBLY HAVING SECURED SETSCREW CONFIGURATION TO PREVENT UNAUTHORIZED HANDLE REMOVAL

CROSS-REFERENCE TO RELATED APPLICATIONS

This is a non-provisional application based upon U.S. provisional patent application Ser. No. 61/738,975, entitled "LOCK ASSEMBLY HAVING SECURED SETSCREW CONFIGURATION TO PREVENT UNAUTHORIZED HANDLE REMOVAL", filed Dec. 18, 2012, from which priority is claimed, and which is incorporated herein by reference in its entirety.

BACKGROUND OF THE INVENTION

1. Field of the Invention

The present invention relates to door locks, and, more particularly, to a lock assembly having a secured setscrew configuration to prevent unauthorized handle removal.

2. Description of the Related Art

A typical exterior lockset includes a handle for operating a retractable latch bolt. In some lock configurations, the handle may be readily removed from the exterior side of the door with the use of a simple tool.

What is needed in the art is a lock assembly configured to resist unauthorized handle removal from the lock assembly. The present invention provides such a solution.

SUMMARY OF THE INVENTION

The present invention provides a lock assembly configured to resist unauthorized handle removal from the lock assembly.

The invention, in one form thereof, is directed to a lock assembly. The lock assembly includes a latch assembly having a retractable bolt. A spindle assembly is operatively coupled to the latch assembly. A coupling mechanism is connected to the spindle assembly. The coupling mechanism has an outer sleeve rotatable around a first axis and has a longitudinal interior opening that extends along the first axis. A lockset includes an operator handle, a setscrew, and a keyed lock core. The operator handle includes a proximal lock core opening, and a distal shaft portion having an axial opening configured to receive the outer sleeve. The distal shaft portion and the outer sleeve are configured to define a through path oriented across the longitudinal interior opening of the outer sleeve. A portion of the through path at the outer sleeve is configured to threadably receive the setscrew to fasten the operator handle to the outer sleeve. A keyed lock core has a tailpiece and is configured for insertion into the proximal lock core opening of the operator handle. The tailpiece is positioned in the longitudinal interior opening of the outer sleeve to obstruct the through path and block access to the setscrew via the through path to prevent unauthorized removal of the operator handle.

The invention, in another form thereof, is directed to a lock assembly. The lock assembly includes a latch assembly having a retractable bolt. A spindle assembly is operatively coupled to the latch assembly. A coupling mechanism is connected to the spindle assembly. The coupling mechanism has an outer sleeve rotatable around a first axis. The outer sleeve includes a sleeve side wall having an exterior surface and a longitudinal interior opening. The sleeve side wall has a sleeve threaded bore that extends through the sleeve side wall and a sleeve through hole that extends through the sleeve side wall. The sleeve through hole and the sleeve threaded bore are located along a second axis perpendicular to the first axis, and the sleeve through hole is diametrically opposed to the sleeve threaded bore across the longitudinal interior opening of the outer sleeve. An exterior lockset is configured to be selectively coupled to the spindle assembly via the coupling mechanism. The exterior lockset includes an exterior operator handle, a set screw and a keyed lock core. The exterior operator handle includes a handle body having a proximal lock core opening and a distal shaft portion. The distal shaft portion includes a handle side wall having an exterior surface, and an axial opening that is longitudinally oriented and extends distally from the proximal lock core opening along the first axis. The axial opening is configured to receive the outer sleeve in a snug sliding fit. A handle through hole extends through the handle side wall in a direction perpendicular to the first axis and the axial opening. The axial opening defines an interior surface having a recess. The recess is at a location that is diametrically opposed to the handle through hole across the axial opening. The handle through hole and the recess of the handle body are axially aligned with the sleeve through hole and the sleeve threaded bore of the outer sleeve along the second axis when the exterior operator handle is installed on the outer sleeve of the coupling mechanism. The setscrew is configured to be received in the sleeve threaded bore of the outer sleeve. The setscrew has a distal end configured to protrude outwardly from the exterior surface of outer sleeve toward the distal shaft portion to engage the recess of the interior surface of the distal shaft portion of the handle body, so as to fasten the exterior operator handle to the outer sleeve of the coupling mechanism. The keyed lock core is configured for insertion into the proximal lock core opening of the handle body. The keyed lock core has a keyed rotatable cylinder and a tailpiece that is attached to and extends distally from the keyed rotatable cylinder. The tailpiece is positioned in the longitudinal interior opening of the outer sleeve so as to obstruct a through path along the second axis, wherein the tailpiece blocks access to the setscrew though the handle through hole of the handle body and the sleeve through hole of the outer sleeve of the coupling mechanism to prevent unauthorized removal of the exterior operator handle.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION OF THE INVENTION

Figure 1:
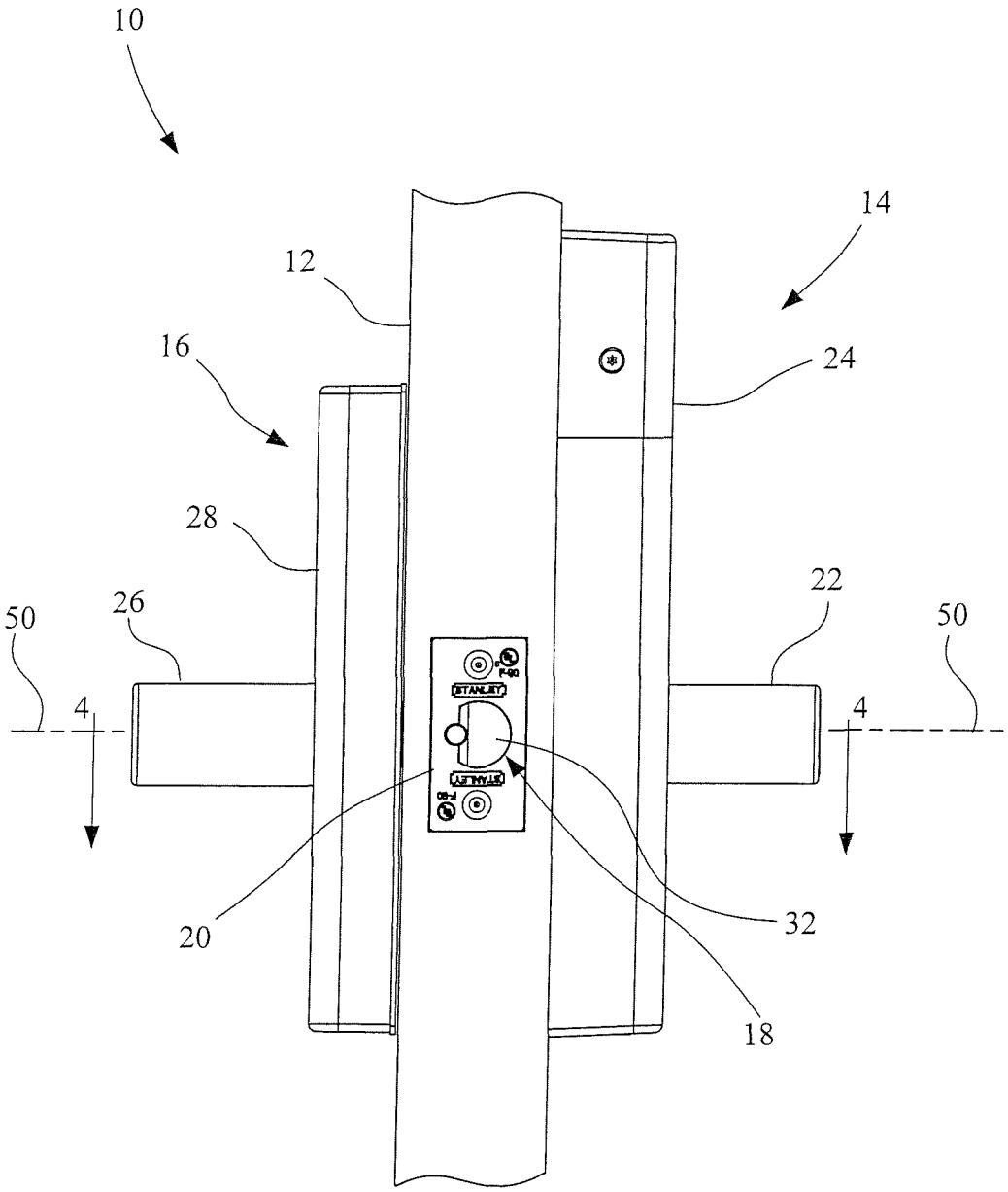
FIG. 1 is a door edge view of a lock assembly in accordance with an embodiment of the present invention, installed on a door.
Figure 2:
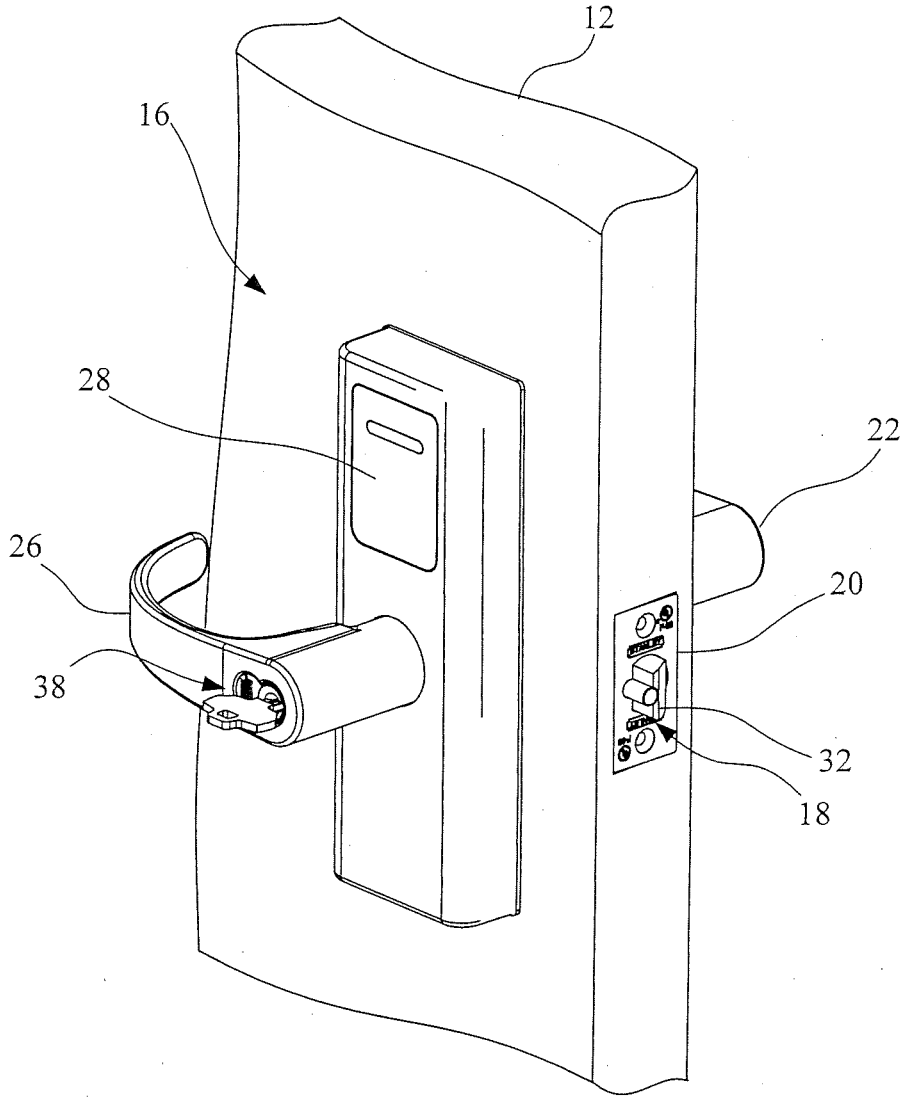
FIG. 2 is a perspective view of the exterior lockset of the lock assembly of FIG. 1, as viewed from the exterior of the door.
Figure 3:
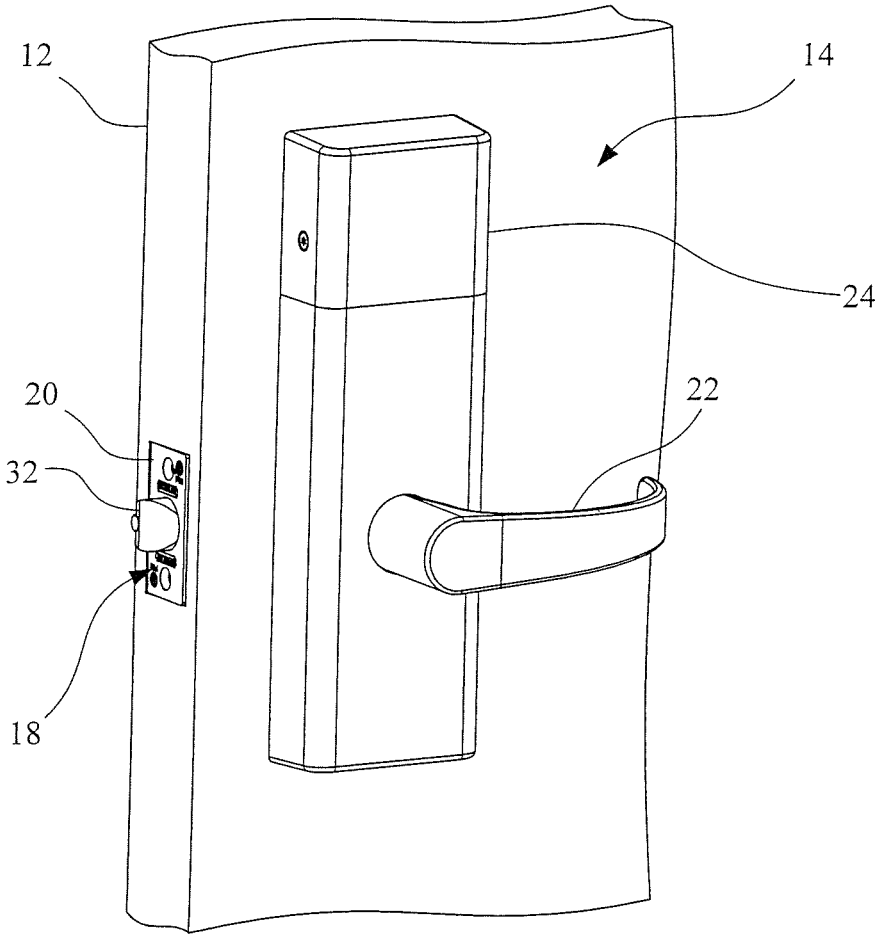
FIG. 3 is a perspective view of the interior lockset of the lock assembly of FIG. 1, as viewed from the interior of the door.

Referring now to the drawings and particularly to FIGS. 1-4, there is shown a lock assembly 10 in accordance with the present invention for mounting on a door 12, and which includes an interior lockset 14, an exterior lockset 16, a latch assembly 18, and a strike 20. Interior lockset 14 includes an interior operator handle 22 and a control electronics module 24. Exterior lockset 16 includes an exterior operator handle 26, and a credential reader 28 that is electrically connected to control electronics module 24.

Figure 4:
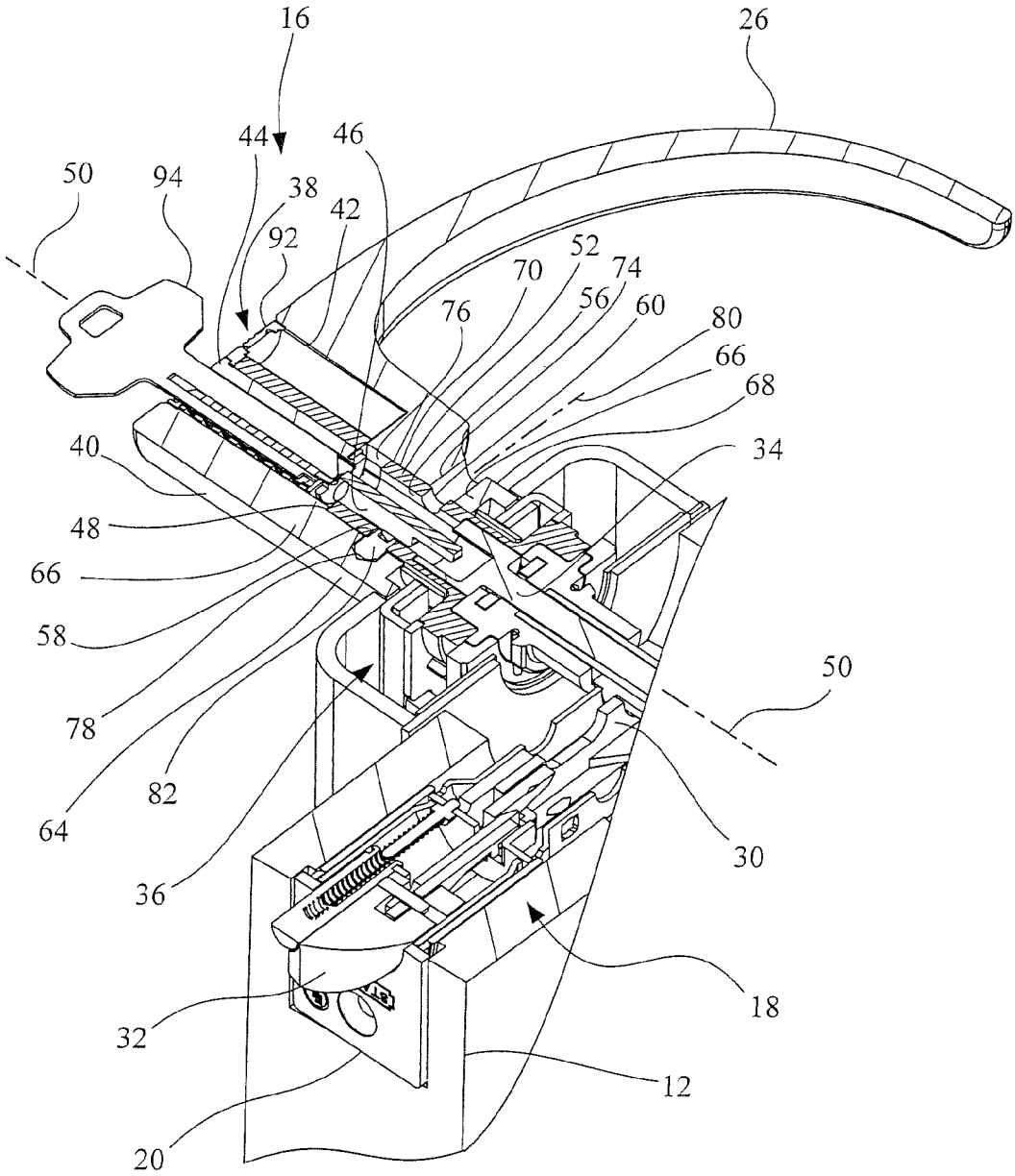
FIG. 4 is a sectioned perspective view of a portion of the lock assembly of FIG. 1 taken along plane 4-4 of FIG. 1.

Referring to FIG. 4, latch assembly 18 is configured with a bolt actuator mechanism 30 and a retractable bolt 32, as is customary in the art. Bolt actuator mechanism 30 is operable by a rotation of a spindle assembly 34 to retract bolt 32.

Interior lockset 14 is configured such that interior operator handle 22 is always operatively coupled to latch assembly 18 during normal operation, such that a rotation of interior operator handle 22 always will result in a retraction of bolt 32.

Referring again to FIGS. 1-4, exterior lockset 16 is configured such that exterior operator handle 26 is selectively coupled to latch assembly 18. In a locked condition, exterior operator handle 26 is decoupled from latch assembly 18, and thus a rotation of exterior operator handle 26 does not result in a retraction of bolt 32. In an unlocked condition, exterior operator handle 26 is coupled to latch assembly 18, and thus a rotation of exterior operator handle 26 will result in a retraction of bolt 32.

One way to achieve the unlocked condition is for a valid credential, e.g., an RFID card, to be read by credential reader 28, which in turn sends a signal to control electronics module 24. Control electronics module 24 then compares the read credential to a database of stored authorized credentials, and if a match is found, responds by operatively coupling the exterior operator handle 26 to latch assembly 18 via a coupling mechanism 36 connected to spindle assembly 34.

Figure 5:
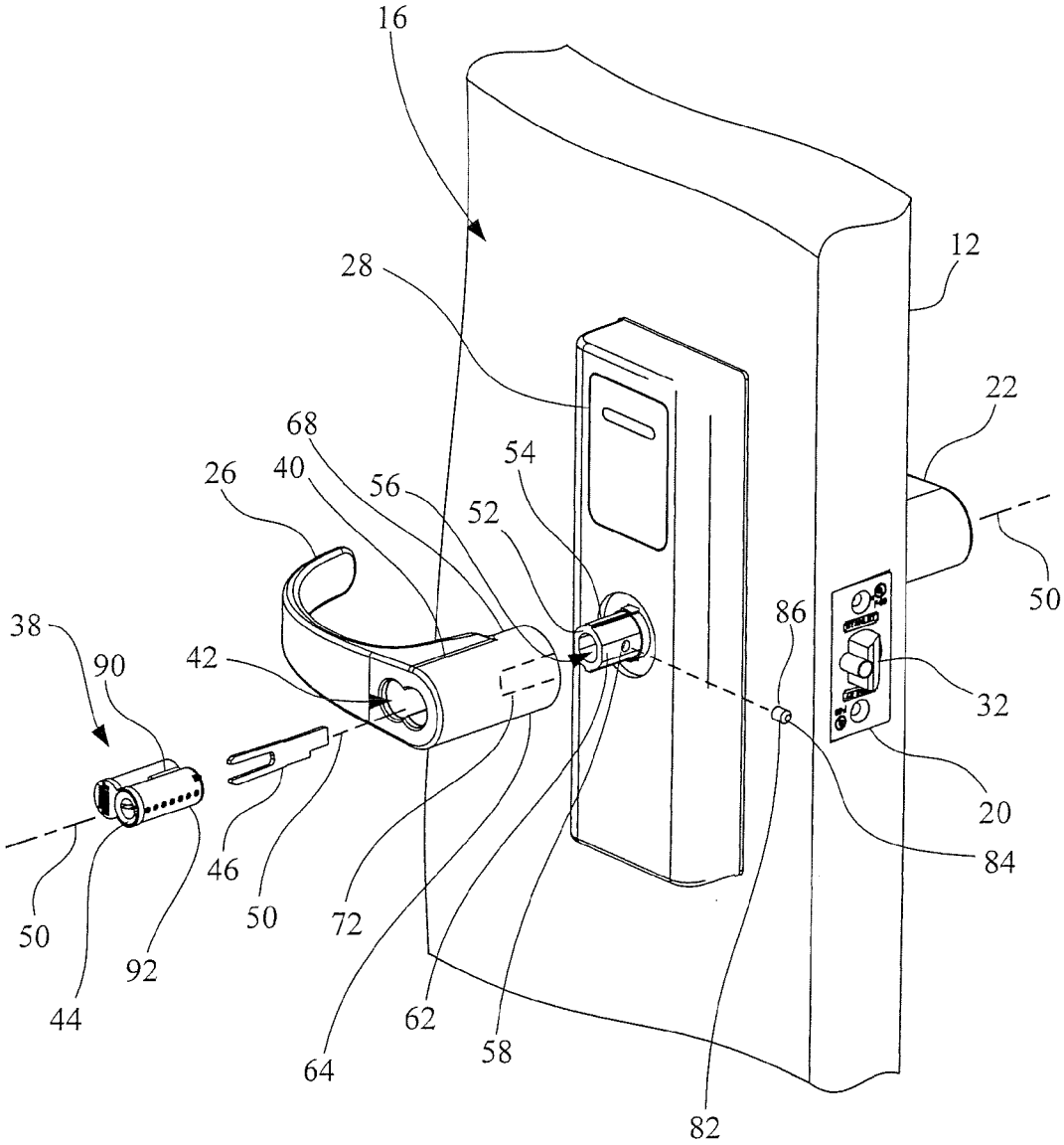
FIG. 5 is a perspective view of the exterior lockset of the lock assembly of FIG. 1, with the handle and the components associated with providing a secure handle shown in a disassembled state.
Figure 6:
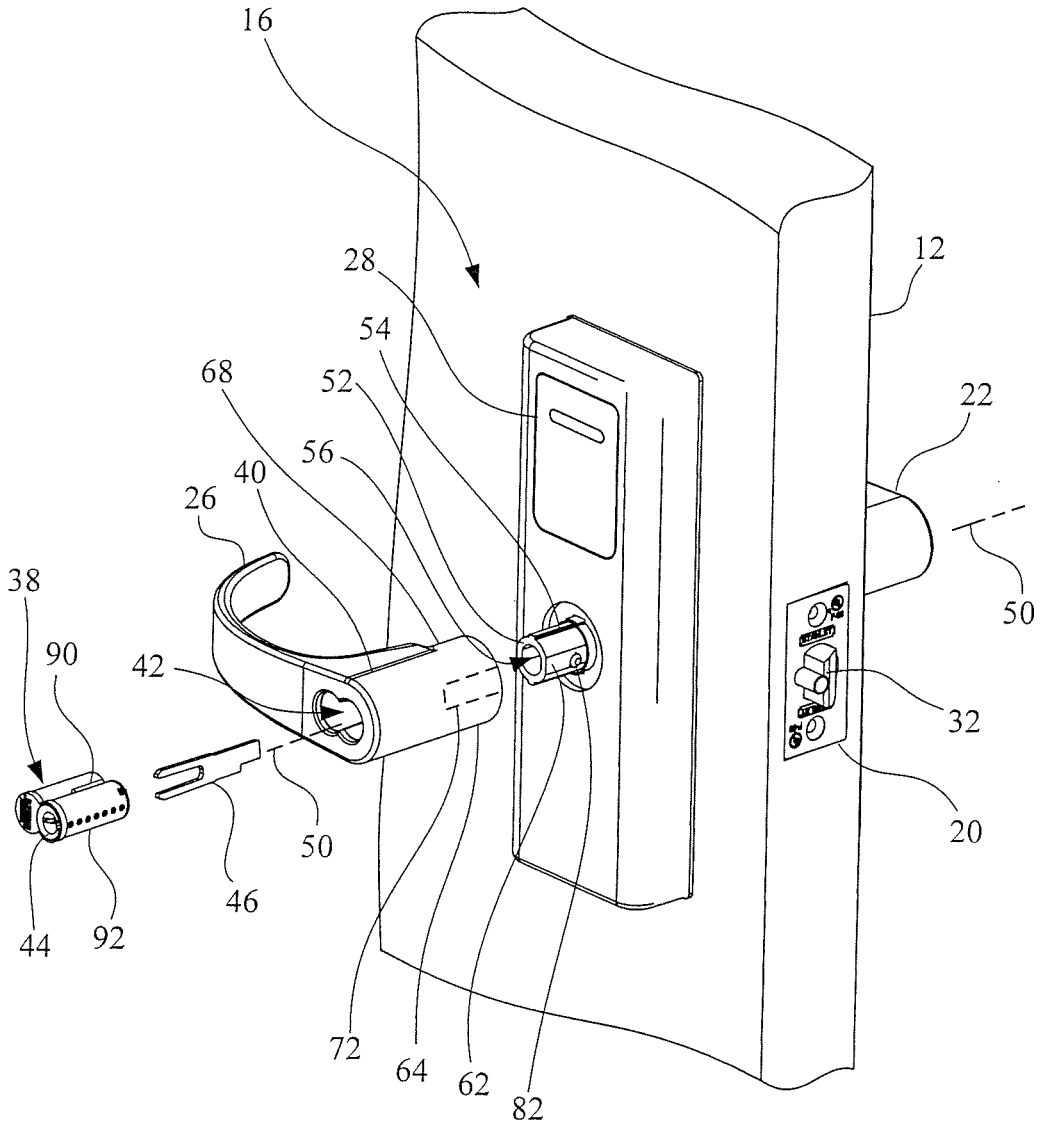
FIG. 6 is a perspective view of the exterior lockset of the lock assembly of FIG. 5, with the setscrew received in the threaded bore of the outer sleeve to which the handle is to be connected.
Figure 7:
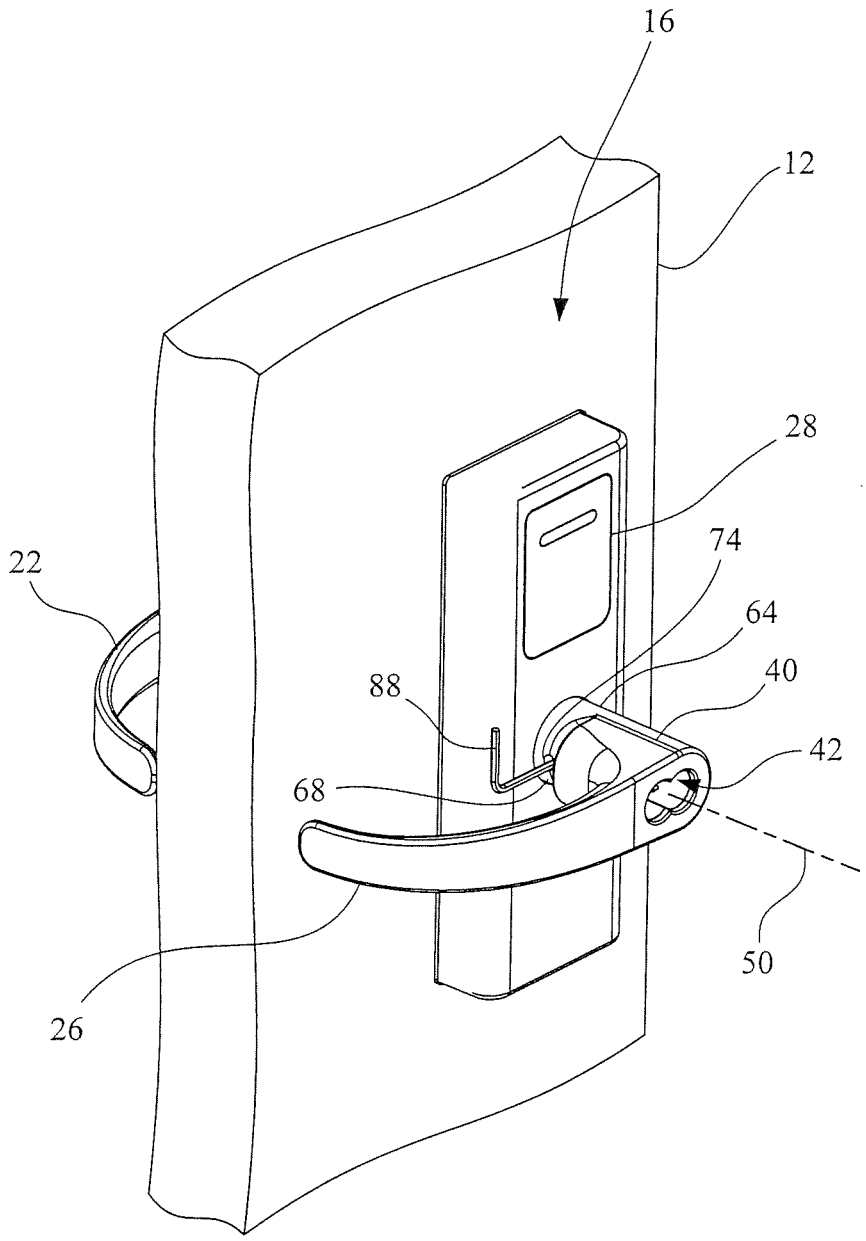
FIG. 7 is a perspective view of the exterior lockset of the lock assembly of FIG. 6, with the handle received over the outer sleeve, and with a hex wrench received through an access through hole in the handle opposite to the threaded bore of the outer sleeve.
Figure 8:
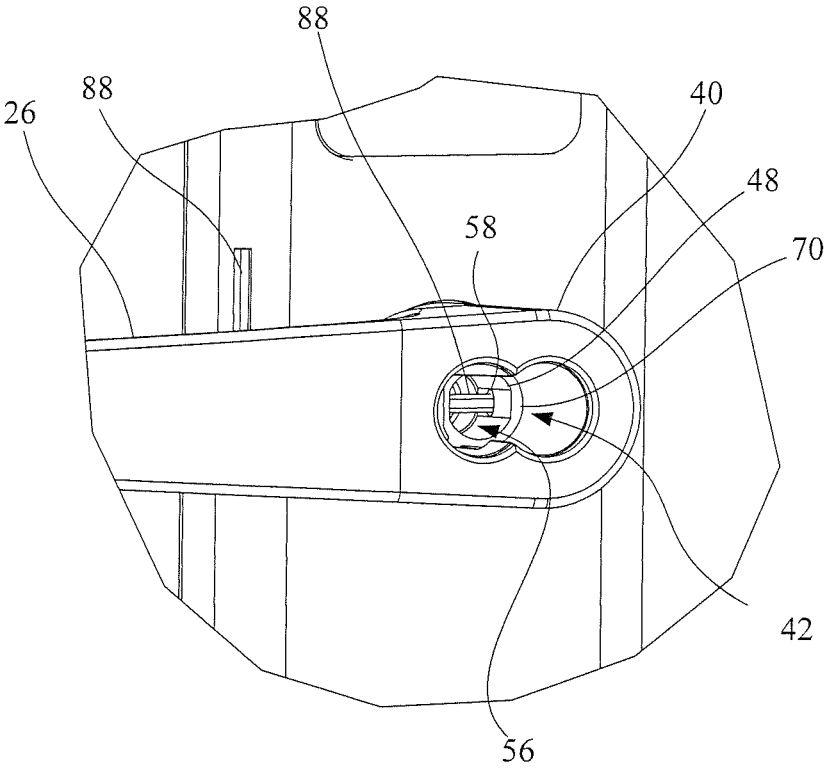
FIG. 8 is a perspective view of the exterior lockset of the lock assembly of FIG. 7, showing the hex wrench engaged with the setscrew of FIG. 6.
Figure 9:
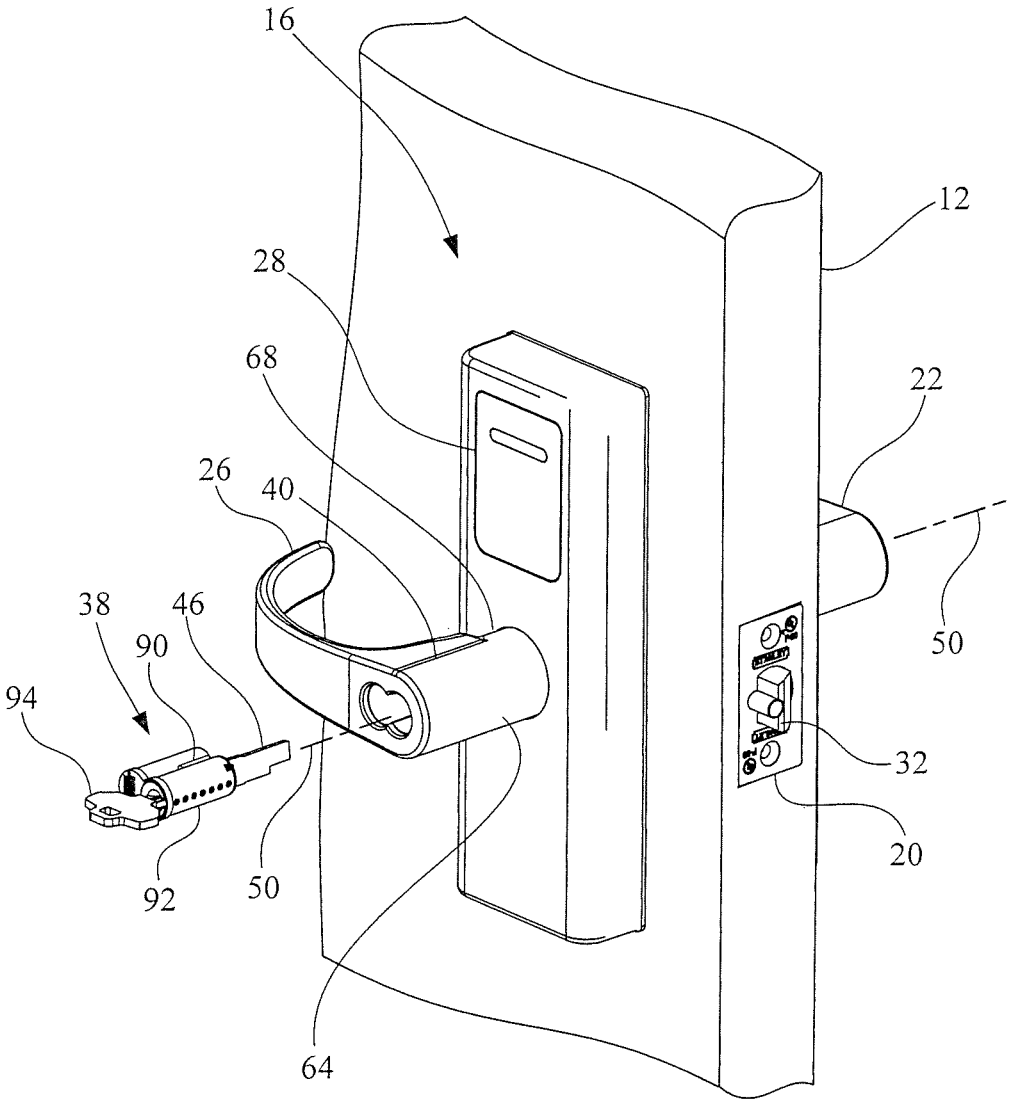
FIG. 9 is a perspective view of the exterior lockset of the lock assembly of FIG. 8, showing the tailpiece connected to an exterior keyed lock core in preparation for insertion into the lock core opening in the exterior handle.
Figure 10:
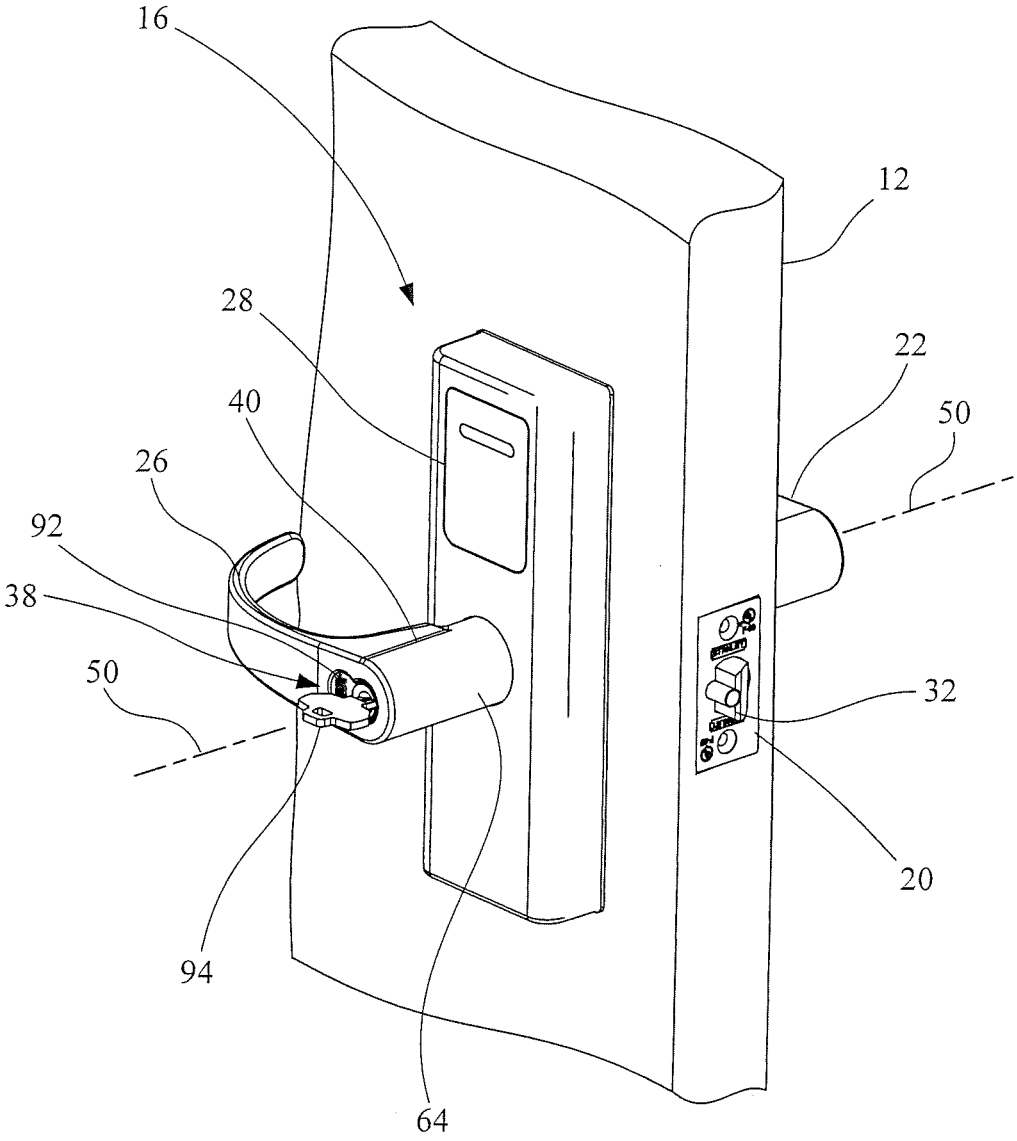
FIG. 10 is a perspective view of the exterior lockset of the lock assembly of FIG. 9, with the exterior keyed lock core inserted into the lock core opening in the exterior handle, and with a control key inserted into the keyed lock core for manipulation to secure the keyed lock core to the exterior handle.

Referring now also to FIGS. 5-7, exterior lockset 16 is also provided with a mechanical override in the form of a key operated interchangeable keyed lock core 38. Exterior operator handle 26 includes a handle body 40 having a proximal longitudinally extending lock core opening 42 for receiving keyed lock core 38. Keyed lock core 38 has a keyed rotatable cylinder 44. A tailpiece 46 in the form of an elongate blade is attached to and extends distally from rotatable cylinder 44 of keyed lock core 38 to engage coupling mechanism 36 to operatively couple the exterior operator handle 26 to latch assembly 18 when keyed lock core 38 is in the unlocked condition, as determined by a rotational position of rotatable cylinder 44 and tailpiece 46.

Coupling mechanism 36 includes an outer sleeve 48, which is rotatably mounted in exterior lockset 16, and extends outwardly from door 12 along an axis 50. Outer sleeve 48 includes a generally cylindrical side wall 52 having an exterior surface 54 and a longitudinal interior opening 56. A threaded bore 58 extends through side wall 52 from exterior surface 54 to longitudinal interior opening 56 in a direction that is generally perpendicular to axis 50 and longitudinal interior opening 56. A through hole 60 extends through side wall 52 from exterior surface 54 to longitudinal interior opening 56 in a direction that is generally perpendicular to axis 50 and interior opening 56. Through hole 60 is diametrically opposed to threaded bore 58 across longitudinal interior opening 56 of outer sleeve 48. Outer sleeve 48 may include a flat 62 on exterior surface 54 that coincides with the location of threaded bore 58. Flat 62 may be one of multiple flats on exterior surface 54.

Handle body 40 of exterior operator handle 26 includes a distal shaft portion 64 that includes a side wall 66 having an exterior surface 68 and a longitudinally oriented axial opening 70. Axial opening 70 is located distal to lock core opening 42, which combine to form a continuous longitudinal opening in exterior operator handle 26 along axis 50. Axial opening 70 is sized and shaped to receive the exterior surface 54 of outer sleeve 48 in a snug sliding fit, and includes a flat 72 that corresponds to flat 62 of outer sleeve 48.

As best shown in FIGS. 4 and 7, handle body 40 includes a through hole 74 that extends through side wall 66 from exterior surface 68 to axial opening 70 in a direction that is generally perpendicular to axis 50 and axial opening 70. Axial opening 70 defines an interior surface 76 into which there is formed a recess 78. Recess 78 is formed in distal shaft portion 64 at a location that is diametrically opposed to through hole 74 across axial opening 70.

Referring to FIGS. 4 and 7-10, when handle body 40 of exterior operator handle 26 is properly positioned over outer sleeve 48, then through hole 74 and recess 78 of handle body 40 will be axially aligned with through hole 60 and threaded bore 58 of outer sleeve 48, with respect to an axis 80 that is perpendicular to axis 50, to define a through path to recess 78, in the absence of tailpiece 46.

Referring to FIGS. 4-10, a standard setscrew 82 is provided having a threaded exterior that terminates at a distal end 84, and has a hex opening at a proximal end 86 for receiving a hex wrench 88. Setscrew 82 is received in the threaded bore 58 of outer sleeve 48 with the distal end 84 positioned to protrude outwardly from exterior surface 54 of outer sleeve 48 toward distal shaft portion 64 of handle body 40. More particularly, setscrew 82 is rotated by hex wrench 88 so as to protrude beyond exterior surface 54 of outer sleeve 48 to tightly engage recess 78 of distal shaft portion 64 of handle body 40, so as to fasten exterior operator handle 26 to outer sleeve 48. To tighten setscrew 82, the hex wrench 88 is inserted into the through path, and more particularly, is inserted through the through hole 74 of handle body 40, then through the through hole 60 of outer sleeve 48, then passes across interior opening 56 of outer sleeve 48 to then engage the hex opening at proximal end 86 of setscrew 82.

When setscrew 82 is tightened by the hex wrench 88, exterior operator handle 26 is restricted from longitudinal motion along axis 50, and thus restricted from removal so long as setscrew 82 is tightly engaged with recess 78 of distal shaft portion 64 of handle body 40.

In order to prevent unauthorized removal of exterior operator handle 26 and/or tampering with setscrew 82, handle body 40 and outer sleeve 48 are configured such that when keyed lock core 38 is installed in exterior operator handle 26, tailpiece 46 is positioned in the longitudinal interior opening 56 of outer sleeve 48 so as to obstruct the through path along axis 80, and thus tailpiece 46 blocks access to setscrew 82 though the through hole 74 of handle body 40 and through hole 60 of outer sleeve 48. Accordingly, access to setscrew 82 is prevented so long as keyed lock core 38 and tailpiece 46 are in their respective installed positions in exterior operator handle 26. Thus, after exterior operator handle 26, keyed lock core 38 and tailpiece 46 are installed, exterior operator handle 26 cannot be removed from outer sleeve 48 without first removing keyed lock core 38 and tailpiece 46.

The interchangeable keyed lock core 38 is configured with a retractable mounting feature 90 (see FIGS. 5 and 6) that selectively is projected outwardly from a core body 92 or is retracted into core body 92 based on a rotational direction of a control key 94. After keyed lock core 38 is inserted into lock core opening 42 of exterior operator handle 26, control key 94 is rotated approximately 7.5 degrees (±10 percent) such that retractable mounting feature 90 projects outwardly from core body 92 to engage a corresponding feature in lock core opening 42 of exterior operator handle 26 to prevent removal of keyed lock core 38 from lock core opening 42. Control key 94 is then removed, and keyed lock core 38 is now ready for operation with a keyed operator key. The operator key, however, has a different keying arrangement from that of control key 94, and thus the operator key is not capable of retracting retractable mounting feature 90. Accordingly, the operator key is not capable of facilitating removal of interchangeable keyed lock core 38 from exterior operator handle 26.

Thus, only authorized individuals with a control key 94 can remove keyed lock core 38 and tailpiece 46 from exterior operator handle 26 to gain access to setscrew 82 that secures exterior operator handle 26 to outer sleeve 48 of exterior lockset 16. This adds additional security to lock assembly 10 on the keyed (exterior) side of door 12, while still permitting exterior handle replacement without having to remove the entire exterior lockset 16 to do so.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lock assembly, comprising:

a latch assembly having a retractable bolt;

a spindle assembly operatively coupled to the latch assembly;

a coupling mechanism connected to the spindle assembly, the coupling mechanism having an outer sleeve rotatable around a first axis and having a longitudinal interior opening that extends along the first axis;

a first lockset including a first operator handle, a setscrew, and a keyed lock core, the first operator handle including a proximal lock core opening, and a distal shaft portion having an axial opening configured to receive the outer sleeve, the distal shaft portion and the outer sleeve configured to define a through path oriented across the longitudinal interior opening of the outer sleeve, a portion of the through path at the outer sleeve configured to threadably receive the setscrew to fasten the first operator handle to the outer sleeve; and the keyed lock core having a keyed rotatable cylinder and a tailpiece and configured for insertion into the proximal lock core opening of the first operator handle, the tailpiece being positioned in the longitudinal interior opening of the outer sleeve to obstruct the through path and block access to the setscrew via the through path to prevent unauthorized removal of the first operator handle, regardless of a rotational position of the keyed rotatable cylinder.

2. The lock assembly of claim 1, wherein the through path is oriented perpendicular to the longitudinal interior opening.

3. The lock assembly of claim 1, wherein:

the outer sleeve of the coupling mechanism includes a sleeve threaded bore and a sleeve through hole, the sleeve through hole being diametrically opposed to the sleeve threaded bore across the longitudinal interior opening of the outer sleeve; and the distal shaft portion of the first operator handle has a handle through hole and a recess, the recess being formed in the distal shaft portion at a location that is diametrically opposed to the handle through hole across the axial opening, wherein the through path extends to the recess of the distal shaft portion, and is defined by the handle through hole being axially aligned with the sleeve through hole and the sleeve threaded bore of the outer sleeve along a second axis that is perpendicular to the first axis.

4. The lock assembly of claim 3, wherein the setscrew is configured to be received in the sleeve threaded bore of the outer sleeve of the coupling mechanism, the setscrew having a distal end positioned to protrude outwardly from the outer sleeve toward the distal shaft portion to engage the recess of the distal shaft portion so as to fasten the first operator handle to the outer sleeve of the coupling mechanism.

5. The lock assembly of claim 1, wherein the keyed rotatable cylinder and the tailpiece is attached to and extends distally from the keyed rotatable cylinder, the tailpiece configured to operatively engage the coupling mechanism to operatively couple the first operator handle to the spindle assembly and the latch assembly upon a rotation of the keyed rotatable cylinder.

6. The lock assembly of claim 1, wherein the outer sleeve includes an exterior surface having a sleeve flat, the first operator handle being sized and shaped to receive the exterior surface of the outer sleeve in a snug sliding fit, and includes a handle flat that corresponds to the sleeve flat of the outer sleeve of the coupling mechanism.

7. The lock assembly of claim 1, wherein the keyed lock core has a core body, and is configured with a retractable mounting feature that selectively is projected outwardly from the core body or is retracted into the core body based on a rotational direction of a control key, the retractable mounting feature configured to project outwardly from the core body to engage a corresponding feature in the proximal lock core opening of the first operator handle to prevent removal of the keyed lock core from the proximal lock core opening.

8. The lock assembly of claim 7, wherein after the keyed lock core is inserted into the proximal lock core opening of the first operator handle, the control key is rotated by an amount such that the retractable mounting feature engages the corresponding feature in the proximal lock core opening of the first operator handle.

9. The lock assembly of claim 1, wherein the first operator handle and the keyed lock core are configured such that only authorized individuals with a control key can remove the keyed lock core having the tailpiece from the proximal lock core opening of the first operator handle to gain access to the setscrew that secures the first operator handle to the outer sleeve of the coupling mechanism.

10. The lock assembly of claim 1, comprising:

an interior lockset having an interior operator assembly, a control electronics module, and an interior operator handle, the interior operator assembly being operatively coupled to the latch assembly via the spindle assembly; and the first lockset including a credential reader, the credential reader being electrically connected to the control electronics module, the control electronics module configured to operatively couple the first operator handle to the spindle assembly via the coupling mechanism when a valid credential is read by the credential reader.

11. A lock assembly, comprising:

a latch assembly having a retractable bolt;

a spindle assembly operatively coupled to the latch assembly;

a coupling mechanism connected to the spindle assembly, the coupling mechanism having an outer sleeve rotatable around a first axis, the outer sleeve including a sleeve side wall having an exterior surface and a longitudinal interior opening, and the sleeve side wall having a sleeve threaded bore that extends through the sleeve side wall and a sleeve through hole that extends through the sleeve side wall, the sleeve through hole and the sleeve threaded bore being located along a second axis perpendicular to the first axis, and the sleeve through hole being diametrically opposed to the sleeve threaded bore across the longitudinal interior opening of the outer sleeve;

an exterior lockset configured to be selectively coupled to the spindle assembly via the coupling mechanism, the exterior lockset including an exterior operator handle, a set screw and a keyed lock core, the exterior operator handle including a handle body having a proximal lock core opening and a distal shaft portion, the distal shaft portion including a handle side wall having an exterior surface, and having an axial opening that is longitudinally oriented and extends distally from the proximal lock core opening along the first axis, the axial opening configured to receive the outer sleeve in a snug sliding fit, and having a handle through hole that extends through the handle side wall in a direction perpendicular to the first axis and the axial opening, the axial opening defining an interior surface having a recess, the recess being at a location that is diametrically opposed to the handle through hole across the axial opening, and configured such that the handle through hole and the recess of the handle body are axially aligned with the sleeve through hole and the sleeve threaded bore of the outer sleeve along the second axis when the exterior operator handle is installed on the outer sleeve of the coupling mechanism;

the setscrew configured to be received in the sleeve threaded bore of the outer sleeve, the setscrew having a distal end configured to protrude outwardly from the exterior surface of the outer sleeve toward the distal shaft portion to engage the recess of the interior surface of the distal shaft portion of the handle body, so as to fasten the exterior operator handle to the outer sleeve of the coupling mechanism; and the keyed lock core configured for insertion into the proximal lock core opening of the handle body, the keyed lock core having a keyed rotatable cylinder and a tailpiece that is attached to and extends distally from the keyed rotatable cylinder, the tailpiece being positioned in the longitudinal interior opening of the outer sleeve so as to obstruct a through path along the second axis wherein the tailpiece blocks access to the setscrew though the handle through hole of the handle body and the sleeve through hole of the outer sleeve of the coupling mechanism, regardless of a rotational position of the keyed rotatable cylinder, to prevent unauthorized removal of the exterior operator handle.

12. The lock assembly of claim 11, wherein the tailpiece is configured to engage the coupling mechanism to operatively couple the exterior operator handle to the latch assembly via the spindle assembly upon a rotation of the keyed rotatable cylinder.

13. The lock assembly of claim 11, wherein the outer sleeve has a sleeve flat on the exterior surface, the exterior operator handle being sized and shaped to receive the exterior surface of the outer sleeve in a snug sliding fit, and includes a handle flat that corresponds to the sleeve flat of the outer sleeve of the coupling mechanism.

14. The lock assembly of claim 11, wherein the keyed lock core has a core body, and is configured with a retractable mounting feature that selectively is projected outwardly from the core body or is retracted into the core body based on a rotational direction of a control key, the retractable mounting feature configured to project outwardly from the core body to engage a corresponding feature in the proximal lock core opening of the exterior operator handle to prevent removal of the keyed lock core from the proximal lock core opening.

15. The lock assembly of claim 14, wherein after the keyed lock core is inserted into the proximal lock core opening of the exterior operator handle, the control key is rotated approximately 7.5 degrees such that the retractable mounting feature engages the corresponding feature in the proximal lock core opening of the exterior operator handle.

16. The lock assembly of claim 11, wherein the keyed lock core is configured such that only authorized individuals with a control key can remove the keyed lock core having the tailpiece from the proximal lock core opening of the exterior operator handle to gain access to the setscrew that secures the exterior operator handle to the outer sleeve of the coupling mechanism.

17. The lock assembly of claim 11, comprising:

an interior lockset having an interior operator assembly, a control electronics module, and an interior operator handle, the interior operator assembly being operatively coupled to the latch assembly via the spindle assembly; and the exterior lockset including a credential reader, the credential reader being electrically connected to the control electronics module, the control electronics module configured to operatively couple the exterior operator handle to the spindle assembly via the coupling mechanism when a valid credential is read by the credential reader.

* * * * *